US006936979B2

(12) United States Patent
Lee et al.

(10) Patent No.: US 6,936,979 B2
(45) Date of Patent: Aug. 30, 2005

(54) FREQUENCY-MODULATED DIMMING CONTROL SYSTEM OF DISCHARGE LAMP

(75) Inventors: San-Jung Lee, Taipei (TW); Ching-Ho Chou, Taipei (TW); Yu-Chi Lee, Taipei (TW)

(73) Assignee: Delta Electronics, Inc., Taoyuan (TW)

( * ) Notice: Subject to any disclaimer, the term of this patent is extended or adjusted under 35 U.S.C. 154(b) by 0 days.

(21) Appl. No.: 10/617,335

(22) Filed: Jul. 10, 2003

(65) Prior Publication Data

US 2004/0021432 A1 Feb. 5, 2004

(30) Foreign Application Priority Data

Aug. 2, 2002 (TW) ..... 91117507 A

(51) Int. Cl.[7] ..... H05B 37/02

(52) U.S. Cl. ..... 315/291; 315/224; 315/307; 315/DIG. 4

(58) Field of Search ..... 315/291, 209 R, 315/200 R, 307, DIG. 4, 246, 276, 283, 287, 224

(56) References Cited

U.S. PATENT DOCUMENTS 3,731,142 A * 5/1973 Spira et al. ..... 315/94
3,961,236 A * 6/1976 Rodek et al. ..... 323/236
4,251,752 A * 2/1981 Stolz ..... 315/206
4,866,350 A * 9/1989 Counts ..... 315/209 R
5,055,746 A * 10/1991 Hu et al. ..... 315/291
5,068,576 A * 11/1991 Hu et al. ..... 315/291
5,107,184 A * 4/1992 Hu et al. ..... 315/291
5,404,082 A * 4/1995 Hernandez et al. ..... 315/219
5,786,671 A * 7/1998 Lee ..... 315/307
5,801,492 A * 9/1998 Bobel ..... 315/244
6,504,315 B2 * 1/2003 Kim ..... 315/224
6,680,585 B2 * 1/2004 Trestman ..... 315/291

* cited by examiner

*Primary Examiner*—Thuy V Tran
(74) *Attorney, Agent, or Firm*—Volpe and Koenig, P.C.

(57) ABSTRACT

The present invention discloses a frequency-modulated dimming control system of a discharge lamp. The frequency-modulated dimming control system of a discharge lamp includes including a voltage regulator having a variable output voltage for converting an input voltage into a bus voltage, wherein a level of the bus voltage is a predetermined ratio of the input voltage, for example 10% of the input voltage, and a ballast circuit for driving the discharge lamp by detecting a variation of the bus voltage and then providing a current to the discharge lamp in response to a frequency modulation of the ballast circuit and the variation of the bus voltage so as to control a light intensity of the discharge lamp.

9 Claims, 4 Drawing Sheets

FREQUENCY-MODULATED DIMMING CONTROL SYSTEM OF DISCHARGE LAMP

FIELD OF THE INVENTION

This invention relates to a dimming control system, and more particularly to a frequency-modulated dimming control system of a discharge lamp.

BACKGROUND OF THE INVENTION

Still now, although there are many kinds of dimmers have been developed already. Two major kinds of dimmers are still commonly used. The first kind is an electronic ballast that is depicted in FIG. 1. Please refer to FIG. 1, which is a schematic diagram showing a circuit of a dimming control system according to a traditional electronic ballast. The traditional electronic ballast 11 uses a four-wire frequency-modulated dimming system. A variable resistor 13 is used in the electronic ballast 11 for controlling the operating frequency of the electronic ballast 11. The AC line voltage $V_{ac}$ applied to a discharge lamp 12 regulates the light intensity of the discharge lamp 12 through frequency-modulated control. The advantage of traditional electronic ballast 11 is that the discharge lamp does not suffer heavy damages after operating a pretty long time under the condition of a low power level. If the damages are happened to the lighting equipments, the construction cost will be pretty expensive.

The second traditional dimmer is a phase-controlled dimmer. A phase control of the AC line voltage is used to drive a lighting equipment for regulating the brightness of the lighting equipment. Please refer to FIG. 2, which is a schematic diagram showing a circuit of a dimming control system according to a traditional phase-controlled dimmer. The TRIAC dimmer 20 seriously connected with a tungsten lamp 21 uses a thyristor to be supplied a positive gate pulse of a short duration at the appointed phase angle of every half circle of the AC line voltage, and then the AC line voltage supplies the output power to the tungsten lamp 21. The phase-controlled dimmer of the prior art is in some range of light intensity form 0% to 100% of output power, for example. The disadvantage of the tungsten lamp 21 is not suitable for the dimming control of electronic ballast.

From the above description, it is known that how to design a dimming control system for providing an efficient and convenient dimming control has become a major problem waited to be solved. In order to overcome the drawbacks in the prior art, a frequency-modulated dimming control system of a discharge lamp is provided. The particular design in the present invention not only solves the problem described above, but also uses a simple circuit to accurately regulate the light intensity of a discharge lamp. It does not need to alter the setting of a power cord and can provide a wide dimming range. Thus, the invention has the utility for the industry.

Therefore, the present invention provides a frequency-modulated dimming control system of a discharge lamp which overcomes the disadvantages described above.

SUMMARY OF THE INVENTION

The main object of the present invention is to provide a frequency-modulated dimming control system of a discharge lamp. The frequency-modulated dimming control system of a discharge lamp has a voltage regulator and a ballast. The output voltage of the voltage regulator is variable. The voltage regulator can be a power supply or a transformer for transferring a DC voltage or an AC line voltage into a bus voltage. The level of the bus voltage is a predetermined ratio of the input DC voltage or the input AC line voltage, for example 10% of the input voltage. The ballast circuit for driving the discharge lamp by detecting a variation of the bus voltage and then providing a current to said discharge lamp in response to a frequency modulation of said ballast circuit and the variation of the bus voltage so as to control a light intensity of the discharge lamp.

It is another object of the present invention is to provide a frequency-modulated dimming control system of a discharge lamp, which provides a not only simple but also convenient way to control the light intensity of a discharge lamp.

It is another object of the present invention to provide a frequency-modulated dimming control system of a discharge lamp, which allows not altering the present arrangement of the two-line power line It is further object of the present invention to provide a frequency-modulated dimming control system of a discharge lamp, which can be used to accurately regulate the discharge lamp light intensity.

It is the other object of the present invention to provide a frequency-modulated dimming control system of a discharge lamp, including a voltage regulator having a variable output voltage for converting an input voltage into a bus voltage, wherein a level of the bus voltage is a predetermined ratio of the input voltage, and a ballast circuit for driving the discharge lamp by detecting a variation of the bus voltage and then providing a current to the discharge lamp in response to a frequency modulation of the ballast circuit and the variation of the bus voltage so as to control a light intensity of the discharge lamp.

Preferably, the input voltage is one of a DC voltage and an AC line voltage.

Preferably, the voltage regulator is one of a power supply and a transformer.

Preferably, the predetermined ratio is 10%.

Preferably, the ballast circuit further including a rectifier for rectifying the bus voltage, a voltage converter for detecting the variation of the bus voltage and amplifying the variation to produce a dimming signal, and a control integrated circuit for controlling an output of the discharge lamp according to the dimming signal.

Preferably, the rectifier is a bridge circuit consisting of four rectifier diodes.

Preferably, the voltage regulator consists of an operational amplifier.

Preferably, the control system further including an inverter consisting of at least one switch, wherein the inverter is controlled by the control integrated circuit, seriously connected between the rectifier and the discharge lamp and adjustably providing a current to the discharge lamp by altering a frequency.

Preferably, the switch is a Metal-Oxide-Semiconductor Field Effect Transistor (MOSFET).

Preferably, the control system further including an inductor seriously connected between the inverter and the discharge lamp for receiving energy from the inverter when the switch is off and providing energy to the discharge lamp.

DETAILED DESCRIPTION OF THE PREFERRED EMBODIMENT

Figure 1:
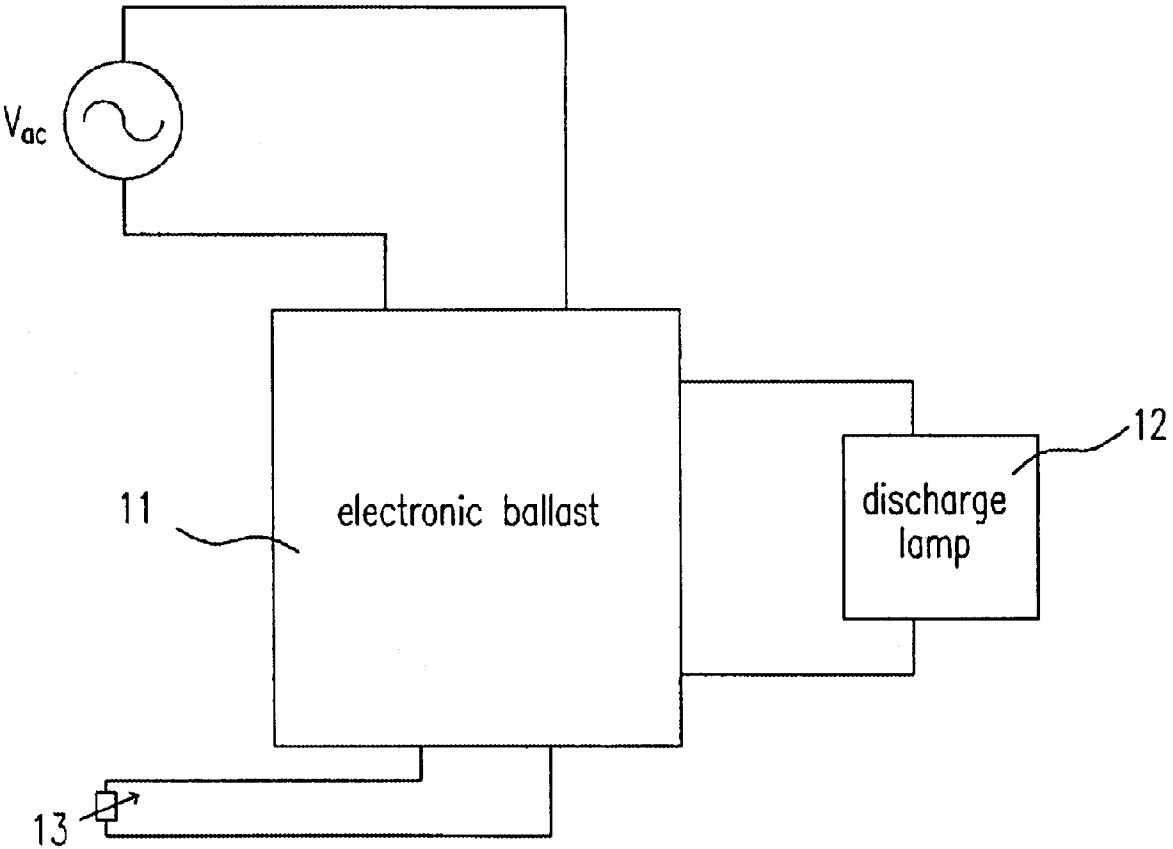
Fig. 1 (PRIOR ART)
FIG. 1 is a schematic diagram showing a circuit of a dimming control system according to a traditional electronic ballast.
Figure 2:
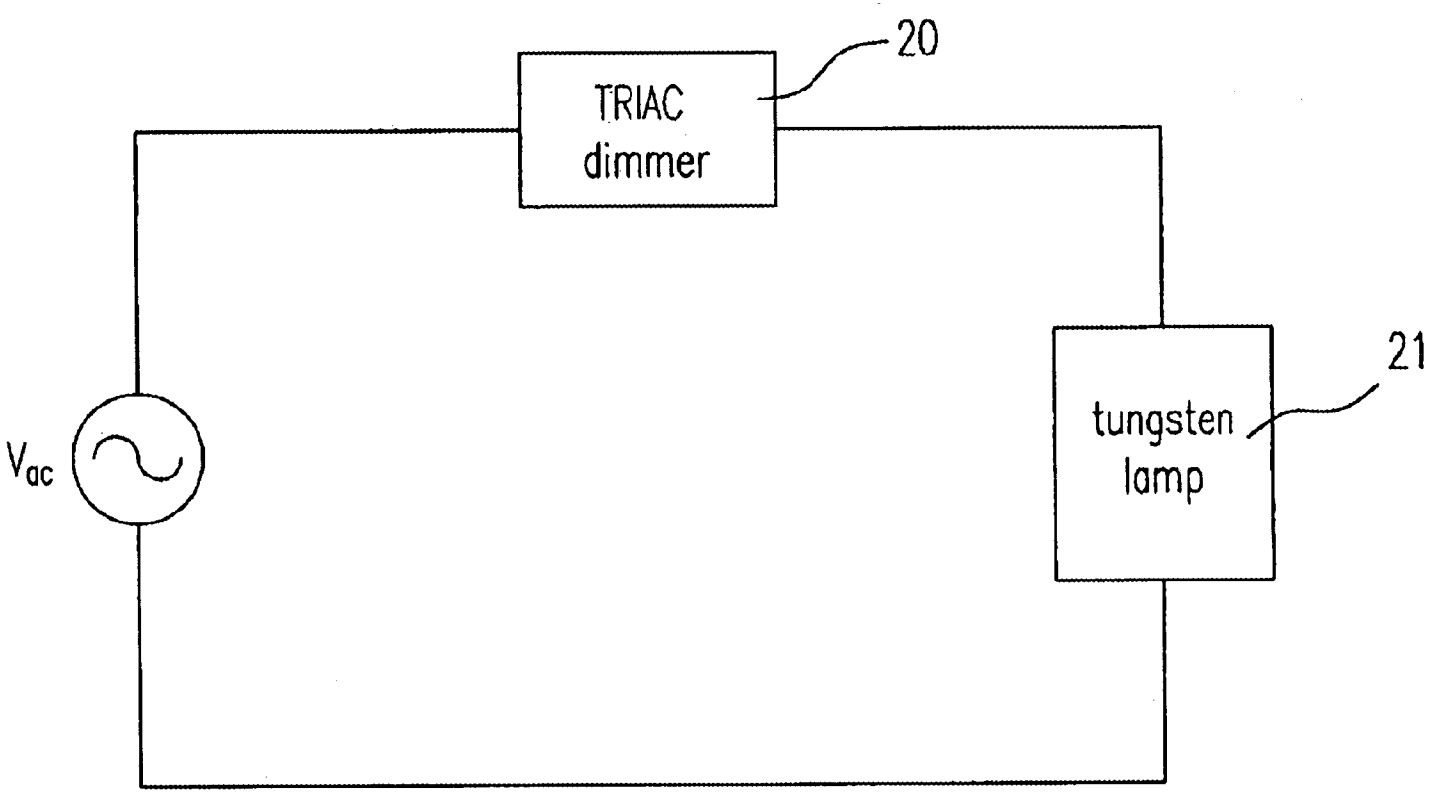
Fig. 2(PRIOR ART)
FIG. 2 is a schematic diagram showing a circuit of a dimming control system according to a traditional phase-controlled dimmer.
Figure 3:
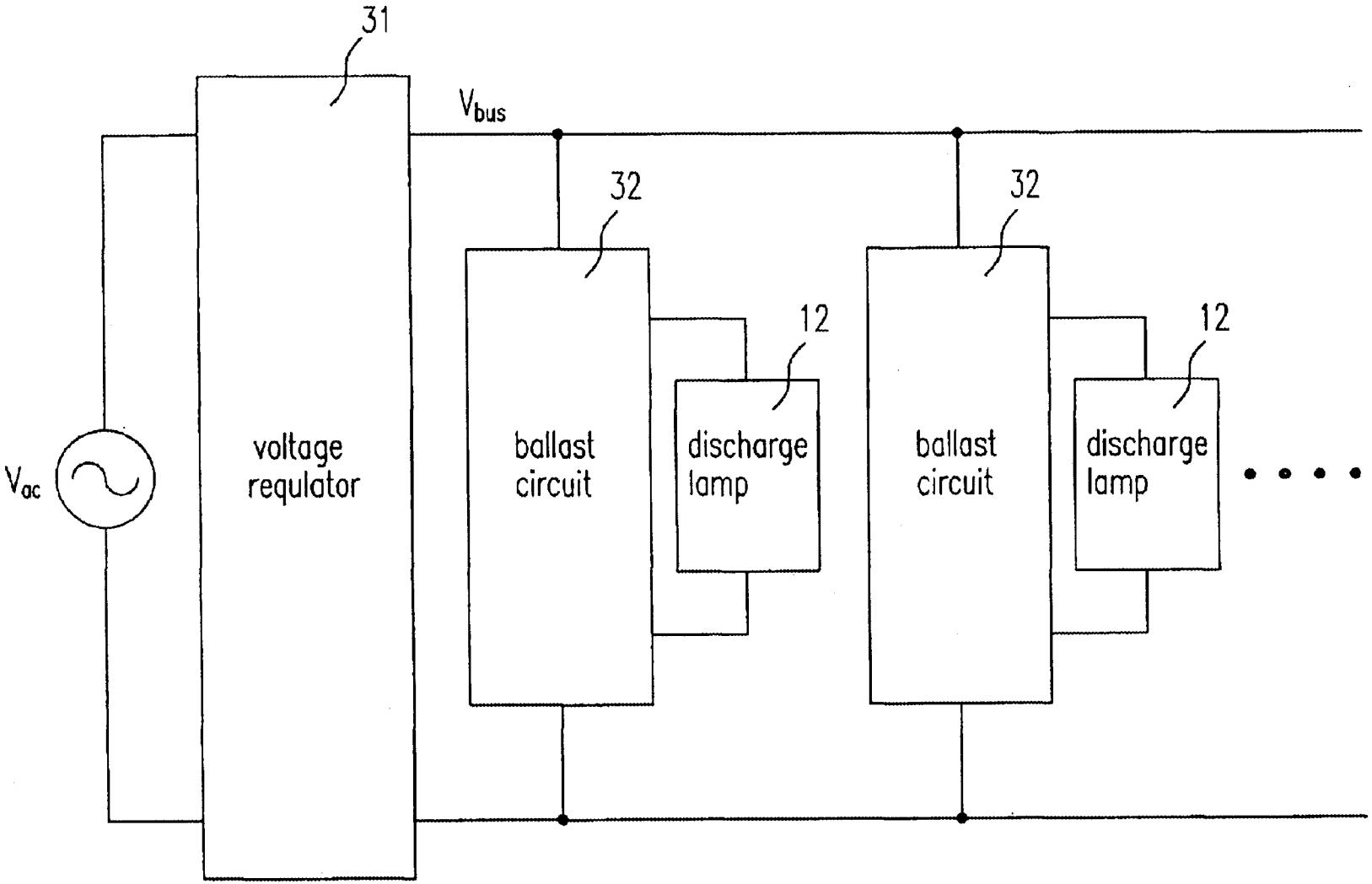
FIG. 3 is a schematic diagram showing a circuit of a dimming control system of a discharge lamp according to a preferred embodiment of the present invention.

Please refer to FIG. 3, which is a schematic diagram showing a circuit of a dimming control system of a discharge lamp according to a preferred embodiment of the present invention. The system is used in single or several discharge lamps 12 for controlling the light intensity. This system includes a voltage regulator 31 which could be a power supply or a transformer, and a ballast circuit 32. The voltage regulator 31 provides a variable output voltage while receiving an AC line voltage $V_{ac}$. The variable output voltage is a bus voltage $V_{bus}$. The level of the bus voltage is a predetermined ratio of the amplitude of the input AC line voltage $V_{ac}$. For example, ten percentage of the amplitude of the AC line voltage $V_{ac}$ equals to the level of the bus voltage $V_{bus}$. The bus voltage Vbus is supplied to the ballast circuit 32. The output power supplied by the ballast circuit 32 is determined according to the variation of the bus voltage for controlling the light intensity of a discharge lamp 12.

Figure 4:
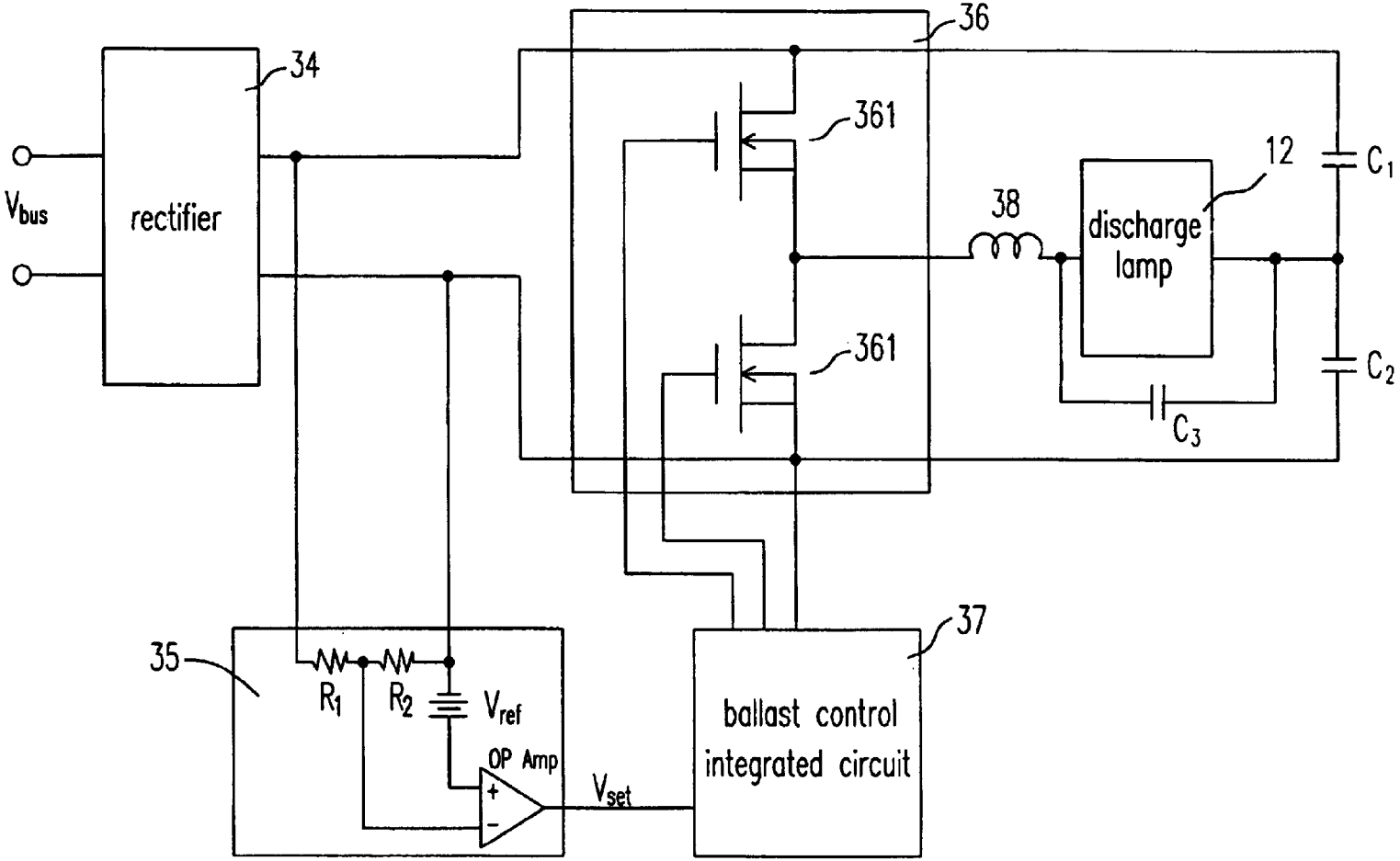
FIG. 4 is a schematic diagram showing a circuit of a ballast circuit in a dimming control system of a discharge lamp according to a preferred embodiment of the present invention.

The circuit structure and the operation method of the ballast circuit 32 can be well illustrated in FIG. 4. Please refer to FIG. 4, which is a schematic diagram showing a circuit of a ballast circuit in a dimming control system of a discharge lamp according to a preferred embodiment of the present invention. The ballast circuit 32 includes a rectifier 34 according to a preferred embodiment of the present invention. The rectifier 34 is a bridge circuit consisting of four rectified diodes for rectifying the bus voltage $V_{bus}$. The ballast circuit 32 further includes a voltage converter 35 according to a preferred embodiment of the present invention. The voltage converter 35 is preferably composed of an operational amplifier, OP Amp, for serving as a dimming signal generator, a voltage divider having two resistors, $R_1$ and $R_2$, for offering an input voltage to the operational amplifier, and a reference voltage, $V_{ref}$, for offering a reference voltage to the operational amplifier. The operational amplifier detects the variation of the bus voltage ($V_{bus}$) and thereby amplifies the variations for generating a dimming signal $V_{set}$. The dimming signal $V_{set}$ is used to drive a ballast control integrated circuit 37. An inverter 36 consists of at least one Metal-Oxide-Semiconductor Field Effect Transistor (MOSFET) 361 for example. The On/Off operation of a MOSFET 361 is controlled by the ballast control integrated circuit 37. The ballast control integrated circuit 37 is a MOS driver. The ballast control integrated circuit 37 needs a microcontroller (not shown) for providing two control signals to start the control function, and a power supply (not shown) for providing the power source for operating. The ballast control integrated circuit 37 controls the operation of the MOSFET 361 according to the value of the dimming signal $V_{set}$ for controlling the output power supplied to the discharge lamp 12, while receiving the dimming signal $V_{set}$ in response to the variations of the bus voltage $V_{bus}$. An inductor 38 will act in different way by the On/Off operation of the MOSFET 361. The inductor 38 stores the energy while the MOSFET 361 is On. On the contrary, the energy is provided from the inductor 38 to the discharge lamp 12 for driving the discharge lamp while the MOSFET 361 is Off. Therefore, the ballast control integrated circuit 37 can control the switching frequency of the MOSFET 361 according to the value of the dimming signal $V_{set}$, i.e. the variation of the bus voltage $V_{bus}$. And then, the ballast control integrated circuit 37 can further controls the output power or energy output to the discharge lamp 12. The ballast circuit 32 further includes two bulk capacitors, $C_1$ and $C_2$, coupled to the half-bridge circuit of the inverter 36, and a resonant capacitor, $C_3$, coupled to the inductor 38 to form the resonant LC circuit. Another method can be used to control the light intensity of the discharge lamp 12 is based on the theory of altering the frequency of the inverter 36 of the ballast circuit 32 for adjusting the lamp current according to a preferred embodiment of the present invention. And then, the lamp current of each discharge lamp will be kept in a fixed value.

In conclusion, the present invention provides a dimming control system for a discharge lamp. It is used not only efficiently but also conveniently to control the light intensity while we want to start the discharge lamp at random luminance and don't want to alter the present arrangement of the two-line power line. Especially, a simple circuit is able to be used in the dimming control system of the present invention. The dimming control system of the present invention can be used to accurately regulate the discharge lamp light intensity ranged from 0% to 100%. So, the dimming control system for a discharge lamp of the present invention is real simple and has a wide dimming range.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A frequency-modulated dimming control system of a discharge lamp, comprising:

a voltage regulator having a variable output voltage for converting an input voltage into a bus voltage, wherein a level of said bus voltage is a predetermined ratio of said input voltage; and a ballast circuit for driving said discharge lamp by detecting a variation of said bus voltage and then providing a current to said discharge lamp in response to a frequency modulation of said ballast circuit and said variation of said bus voltage so as to control a light intensity of said discharge lamp, comprising:

a rectifier for rectifying said bus voltage;

a voltage converter for detecting said variation of said bus voltage and amplifying said variation to produce a dimming signal; and a control integrated circuit for controlling an output of said discharge lamp according to said dimming signal.

2. The control system as claimed in claim 1, wherein said input voltage is one of a DC voltage and an AC line voltage.

3. The control system as claimed in claim 1, wherein said voltage regulator is one of a power supply and a transformer.

4. The control system as claimed in claim 1, wherein said predetermined ratio is 10%.

5. The control system as claimed in claim 1, wherein said rectifier is a bridge circuit consisting of four rectifier diodes.

6. The control system as claimed in claim 5, wherein said voltage converter comprises an operational amplifier.

7. The control system as claimed in claim 5 further comprising an inverter comprising at least one switch, wherein said inverter is controlled by said control integrated circuit, connected between said rectifier and said discharge lamp and adjustably providing a current to said discharge lamp by altering a frequency.

8. The control system as claimed in claim 7, wherein said switch is a Metal-Oxide-Semiconductor Field Effect Transistor (MOSFET).

9. The control system as claimed in claim 7 further comprising an induction device connected between said inverter and said discharge lamp for receiving energy from said inverter when said switch is off and providing said energy to said discharge lamp.

* * * * *